US011400327B2

(12) United States Patent
Um et al.

(10) Patent No.: US 11,400,327 B2
(45) Date of Patent: Aug. 2, 2022

(54) DISCHARGE PRESSURE ADJUSTMENT CARTRIDGE THAT IS COMBINED WITH FIRE HOSE PRESSURE RELIEF VALVE

(71) Applicant: FINO CO., LTD., Cheonan-si (KR)

(72) Inventors: Ki Ryeok Um, Sejong (KR); Jin Rok Oh, Cheonan-si (KR)

(73) Assignee: FINO CO., LTD., Cheonan-si (KR)

( * ) Notice: Subject to any disclaimer, the term of this patent is extended or adjusted under 35 U.S.C. 154(b) by 301 days.

(21) Appl. No.: 16/489,818

(22) PCT Filed: Aug. 23, 2018

(86) PCT No.: PCT/KR2018/009717

§ 371 (c)(1),
(2) Date: Aug. 29, 2019

(87) PCT Pub. No.: WO2019/216490

PCT Pub. Date: Nov. 14, 2019

(65) Prior Publication Data

US 2020/0338374 A1 Oct. 29, 2020

(30) Foreign Application Priority Data

May 8, 2018 (KR) ..... 10-2018-0052782

(51) Int. Cl.

| | |
|---|---|
| ***A62C 31/03*** | (2006.01) |
| ***B05B 1/30*** | (2006.01) |
| ***F15D 1/02*** | (2006.01) |
| ***A62C 31/02*** | (2006.01) |

(52) U.S. Cl.

CPC ..... *A62C 31/03* (2013.01); *A62C 31/02* (2013.01); *B05B 1/30* (2013.01); *F15D 1/025* (2013.01)

(58) Field of Classification Search

CPC ..... A62C 31/02; A62C 31/03; F15D 1/0005; F15D 1/02; F15D 1/065; F15D 1/025; F16L 55/027; F16L 55/02727

See application file for complete search history.

(56) References Cited

U.S. PATENT DOCUMENTS

| | | | | |
|---|---|---|---|---|
| 2,953,160 A | | 9/1960 | Brazier | |
| 4,232,710 A | * | 11/1980 | Gallo | B67D 9/02 137/615 |
| 2005/0056435 A1 | * | 3/2005 | Price | A62C 27/00 169/52 |

FOREIGN PATENT DOCUMENTS

| | | | |
|---|---|---|---|
| KR | 10-2009-0083266 | A | 8/2009 |
| KR | 10-1277009 | B1 | 6/2013 |
| KR | 10-1395664 | B1 | 5/2014 |
| KR | 10-1634256 | B1 | 6/2016 |
| KR | 10-1780221 | B1 | 9/2017 |
| KR | 10-1831163 | B1 | 2/2018 |

* cited by examiner

*Primary Examiner* — Jason J Boeckmann
(74) *Attorney, Agent, or Firm* — Rabin & Berdo, P.C.

(57) ABSTRACT

The present invention relates to a discharge pressure adjustment cartridge that is combined with a fire hose pressure relief valve and, more particularly, to a discharge pressure adjustment cartridge that is combined with a fire hose pressure relief valve, the discharge pressure adjustment cartridge enabling a firefighter to easily control the discharge direction of firefighting water by removing upward force that is generated in the firefighting water in the opposite direction to gravity by discharge pressure.

5 Claims, 9 Drawing Sheets

A - A'

DISCHARGE PRESSURE ADJUSTMENT CARTRIDGE THAT IS COMBINED WITH FIRE HOSE PRESSURE RELIEF VALVE

TECHNICAL FIELD

The present invention relates to a discharge pressure adjustment cartridge that is combined with a fire hose pressure relief valve and, more particularly, to a discharge pressure adjustment cartridge that is combined with a fire hose pressure relief valve, the discharge pressure adjustment cartridge enabling a firefighter to easily control the discharge direction of firefighting water by removing upward force that is generated in the firefighting water in the opposite direction to gravity by discharge pressure.

BACKGROUND ART

Generally, the firefighting water is discharged to the fire point through a water discharging gun.

The water discharging gun is a device for discharging high-pressure firefighting water on the scene of a fire. Normally, the pressure of the water discharging nozzle connected to the fire engine is about 0.7 [MPa], and when the firefighting water is discharged at high pressure depending on the situation, the pressure of the water discharging nozzle is more than 1.4 [MPa].

More specifically, when the pressure of the water discharging nozzle is 0.7 [MPa], it is impossible for only one firefighter to endure for more than 20 minutes. If the pressure is 1.4 [MPa] or more, it is quite hard on at least two firefighters Therefore, the water discharging gun for discharging the firefighting water is ironically impossible to grasp for a long time by firefighters and there is a danger that a secondary safety accident may occur.

In addition, on account of various factors transmitted through the fire hose (malfunction of the water pressure of the fire engine or hose kink and so on), the possibility of detachment of the water discharging gun, which has been grasped, is further increased due to sudden pressure fluctuation or vortex in the firefighting water.

Such a detachment of the water discharging gun causes another safety accident due to the fluctuation of the water discharging gun such as the hit of the faces of the firefighter or the peoples around him and the damage of the peripheral structures in the case of an emergency fire.

In addition, since there are a lot of flammable substances in the warehouse type store or the industry site of mass production system, the extinguishing time lasts for more than 1 hour. In this case, the firefighters of extinguishing a fire cannot keep the water discharging work for a long time due to the pressure of the water discharging nozzle. At the same time, during the water discharging work, since two or three firefighters must always support the water discharging gun to distribute power, there is a problem in that it causes manpower losses.

In order to solve these conventional problems, various water discharging guns and fire-fighting robots have been developed and deployed in the field. However, conventional water discharging guns have been developed focusing on the effect of improving the water discharging distance or improving the density of the firefighting water. Also, the fire-fighting robot cannot be moved quickly due to the weight of about 1.5 ton on average. Moreover, since the fire-fighting robot is a device manufactured at a high cost, it is difficulty to be practically applied on the spot.

In other words, there are few techniques for solving the problems inherent in the water discharging guns in the prior art.

Therefore, it requires water discharging guns capable of safely discharging the water to the fire point by means of the firefighters without a great expenditure of power even during water discharging work of high pressure for a long period and in that it is no inconvenience for firefighters and field operators. Finally, it is necessary to develop the water discharging gun capable of easily utilizing on the fire site for anyone.

As the prior art related to the water discharging pressure control cartridge coupled to the fire hose pressure relief valve, as shown in FIG. 10(*a*), "a firefighting water discharger for long-range spray" (hereinafter referred to as "Patent literature 1") of Korean Patent Registration No. 10-1395664 relate to a firefighting water discharger for long-range spray including a barrel part connected to a firefighting water pipe, a water discharging gun including a spray nozzle spraying firefighting water coming from the barrel part, and a pressure raising filter having two or more dividing wings, inserted into the barrel part, and dividing an inner space of the barrel part into two or more spaces in a radial form. The water discharging cloth improves a spray range of firefighting water since the pressure raising filter minimizes a vortex in the barrel part and guides the firefighting water when the firefighting water comes into the barrel part. Accordingly, the spray range of the firefighting water is improved and the firefighting water is prevented from scattering.

As another prior art, as shown in FIG. 10(*b*), "a firefighting water discharger" (hereinafter referred to as "Patent literature 2") of Korean Patent Registration No. 10-1634256 provides a firefighting water discharger coupled to a firefighting hose to discharge firefighting water and to suppress a fire, which comprises a firefighting water discharge unit discharging the firefighting water supplied via the firefighting hose; a firefighting water inlet unit making the firefighting water, supplied to the firefighting water discharge unit, flow from the firefighting hose; a connection tube connecting the firefighting water inlet unit to the firefighting water discharge unit; a vertical rotating unit connected to the firefighting water discharge unit and the connection tube, and rotating the firefighting water discharge unit and the connection tube vertically; a horizontal rotating unit connected to the firefighting water discharge unit and the firefighting water inlet unit, and rotating the firefighting water discharge unit and the firefighting water inlet unit horizontally; and a controller controlling the rotation of the vertical rotating unit and the horizontal rotating unit. Thus, the present invention enables a firefighter or an operator to rotate the firefighting water discharge unit, for discharging the firefighting water, vertically and horizontally using the controller, thereby protecting the firefighter from flames even if the firefighter does not approach a fire site in order to operate the firefighting water discharger, and enables the firefighter or the operator to conveniently operate the vertical and the horizontal rotation of the firefighting water discharge unit using the controller, thereby enhancing the convenience of the work.

As described above, the Patent literatures 1 and 2 can be applied to a technique in which the effect of improving the water discharging distance and the density of the water for firefighting, which does not solve the above-mentioned conventional problems and a technique for improving the convenience of the operation by operating firefighting water discharger vertically and horizontally through the controller.

However, they are different from the fundamental problem to be solved by the present invention.

In other words, the present invention differs from the Patent literatures 1 and 2 in the technical characteristics because the problems to be solved, the process for solving the problems, and the effects exerted by solving the problems are different to each other.

PATENT LITERATURE

Patent Literature 1: Korean Patent Registration No. 10-1395664 (May 9, 2014).

Patent Literature 2: Korean Registered Patent No. 10-1634256 (Jun. 22, 2016)

DISCLOSURE

Technical Problem

Accordingly, the present invention has been made in an effort to solve the problems and an object of the present invention is to provide a discharge pressure adjustment cartridge that enables easy control of firefighting water discharged from a fire hose.

That is, an object of the present invention is to enable a firefighter to easily handle discharge equipment in fire control by controlling discharge pressure of firefighting water that is discharged from a fire hose by being disposed and coupled between a pressure relief valve of the fire hose and the discharge equipment.

Ultimately, an object of the present invention is to provide a discharge pressure adjustment cartridge that adjusts discharge pressure so that even only one firefighter can maintain and control discharge equipment through which firefighting water flowing inside from a fire hose is discharged.

Another object of the present invention is to provide a discharge pressure adjustment cartridge that adjusts discharge pressure of firefighting water to prevent a waste of firefighting water due to discharge pressure of firefighting water in the early stage of fire control, to prevent a safety accident that is generated when a firefighter cannot control discharge equipment due to discharge pressure of firefighting water, and to enable even only one firefighter to withstand discharge pressure of firefighting water.

Technical Solution

According to one aspect of the present invention so as to accomplish these objects, there is provided to a discharge pressure adjustment cartridge that is combined with fire hose pressure relief valve, the discharge pressure adjustment cartridge including:

a hollow cartridge housing having a predetermined length and having an end coupled to discharge equipment and the other end coupled to a fire hose pressure relief valve;

a discharge pressure adjustment nozzle inserted and fixed in the cartridge housing and adjusting the discharge pressure of firefighting water passing through the cartridge housing;

a discharge equipment-coupling portion formed at an end of the cartridge housing to be coupled to the discharge equipment;

a fire hose pressure relief valve-coupling portion formed at the other end of the cartridge housing to be coupled to the fire hose pressure relief valve;

a first firefighting water inflow section formed over the discharge pressure adjustment nozzle inserted and fixed in the cartridge housing; and a second firefighting water inflow section formed under the discharge pressure adjustment nozzle inserted and fixed in the cartridge housing, wherein it is characterized by preventing the discharge equipment from unexpectedly moving up due to discharge pressure of the firefighting water flowing inside from the fire hose FH by adjusting the discharge pressure, and by enabling a firefighter to easily handle the discharge equipment by applying force in the gravity direction to the discharge equipment.

At this time, the discharge pressure adjustment nozzle includes:

a nozzle top increasing the flowing speed of the firefighting water passing through the first firefighting water inflow section;

a nozzle bottom enabling the firefighting water to pass through the second firefighting water inflow section;

a first nozzle surface being in contact with ends of the nozzle top and the nozzle bottom and enabling the firefighting water flowing inside from the fire hose pressure relief valve to change into a firefighting water through the first firefighting water inflow section and the second firefighting water inflow section and to be discharged to a fire position through the discharge equipment;

a second nozzle surface being in contact with the nozzle top and the nozzle bottom, extending downward with a predetermined inclination from the nozzle top, and dividing the firefighting water flowing inside from the fire hose pressure relief valve; and a firefighting water division blade pointed at the joint of the second nozzle surface and the nozzle bottom to enable firefighting water flowing inside from the fire hose pressure relief valve to be divided without resistance, wherein the firefighting water flowing inside through the fire hose pressure relief valve from the fire hose is divided into two streams to pass through the first firefighting water inflow section and the second firefighting water inflow section.

It should be understood that the terminology or the words used in claims should not be interpreted in normally or lexically sense. It should be interpreted as meaning and concept consistent with the technical idea of the present invention, based on the principle that the inventor can properly define the concept of the term in order to describe its invention in the best way.

Therefore, the embodiments described in the present specification and the configurations shown in the drawings are only the most preferred embodiments of the present invention, and not all the technical ideas of the present invention are described. Therefore, it is to be understood that various equivalents and modifications are possible.

Advantageous Effects

As described in the above components and action according to the present invention, it is possible to easily control the firefighting water to be inflowed from the fire hose pressure relief valve.

That is, by controlling the water pressure of the firefighting water flowing from the fire hose pressure relief valve, finally, it enables the firefighter to easily handle the discharge equipment in fire control.

In addition, since the discharging pressure of the firefighting water is controlled, even only one firefighter can maintain and control the discharge gun for a long time.

More particularly, the force generated by the firefighting water owing to the discharge pressure (upward force generated in the opposite direction to gravity of the firefighting water) is cancelled out through the configuration of the discharge pressure adjustment cartridge, so that the firefighting water is discharged straight in parallel with the ground or downward with a predetermined inclination in the direction to gravity by means of the discharge equipment, thereby enabling the firefighter to easily handle the discharge gun for a long time.

In addition, it can prevent the waste of firefighting water due to discharge pressure of firefighting water in the early stage of fire control and prevent a safety accident that is generated when the discharge gun held by the firefighter is detached.

For example, it prevents the safety accident caused by the fluctuation of the water discharging gun, such as the hit of the faces of the firefighter or the peoples around him and the damage of the peripheral structures.

In addition, by eliminating the waste of the firefighters for controlling the firefighting water and the rapid fire suppression at the fire scene, it can maximizes the effect of rescue and rescue activities in carrying out the duty of protecting the life, body and property by means of the firefighter.

BRIEF DESCRIPTION OF DRAWINGS

The above and other objects, features and advantages of the present invention will be more apparent from the following detailed description taken in conjunction with the accompanying drawings, in which.

REFERENCE SIGNS LIST

Figure 1:
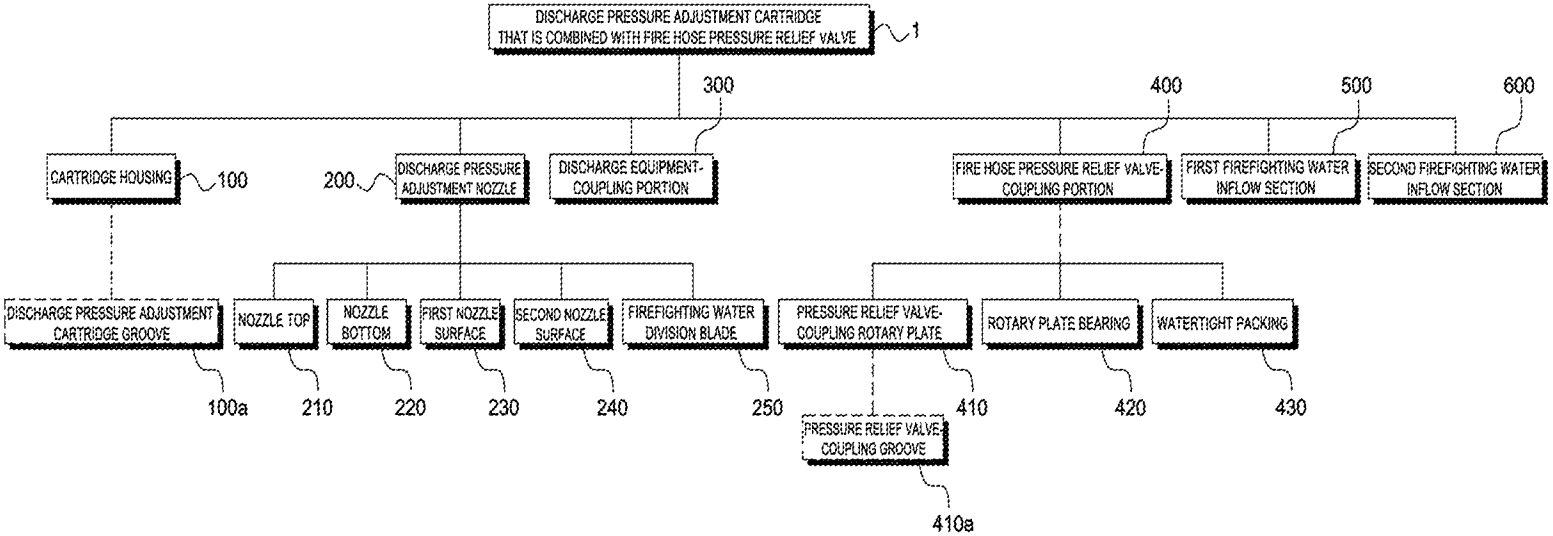
FIG. 1 is a diagram showing the configuration of a discharge pressure adjustment cartridge that is combined with fire hose pressure relief valve of the present invention.

1: discharge pressure adjustment cartridge that is combined with fire hose pressure relief valve
100: hollow cartridge housing
100*a*: discharge pressure adjustment cartridge grooves
200: discharge pressure adjustment nozzle
210: nozzle top
220: nozzle bottom
230: first nozzle surface
240: second nozzle surface
250: firefighting water division blade
300: discharge equipment-coupling portion
400: fire hose pressure relief valve-coupling portion
410: pressure relief valve-coupling rotary plate
410*a*: pressure relief valve-coupling groove
420: rotary plate bearing
430: watertight packing
500: first firefighting water inflow section
600: second firefighting water inflow section
S100: inflow step of firefighting water FW1
S200: division step of firefighting water FW1
S300: discharge step of firefighting water FW2
A1: area of first firefighting water inflow section (500)
A2: area (A2) of second firefighting water inflow section (600)
FW1: firefighting water
FW2: firefighting water with adjusted discharge pressure
ET: male thread
FH: fire hose
FN: discharge equipment
FNa: discharge equipment-coupling grooves
IT: female thread
RV: fire hose pressure relief valve

BEST MODE

Mode for Invention

Hereinafter, functions, components, and actions of the discharge pressure adjustment cartridge that is combined with fire hose pressure relief valve of the present invention will be described in more detail with reference to the accompanying drawings.

Figure 2:
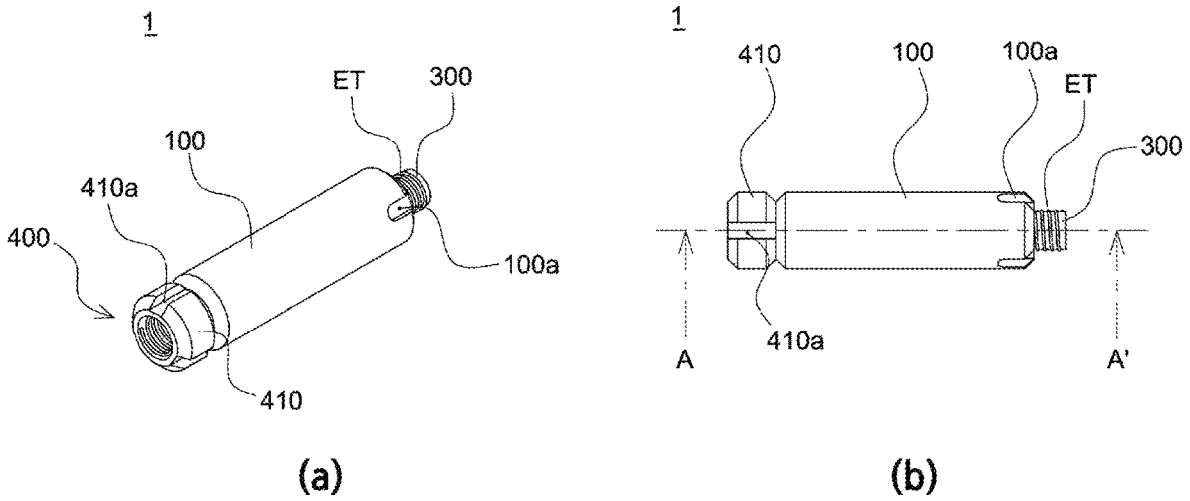
FIG. 2 is a perspective view and a plan view of the discharge pressure adjustment cartridge that is combined with fire hose pressure relief valve of the present invention.
Figure 3:
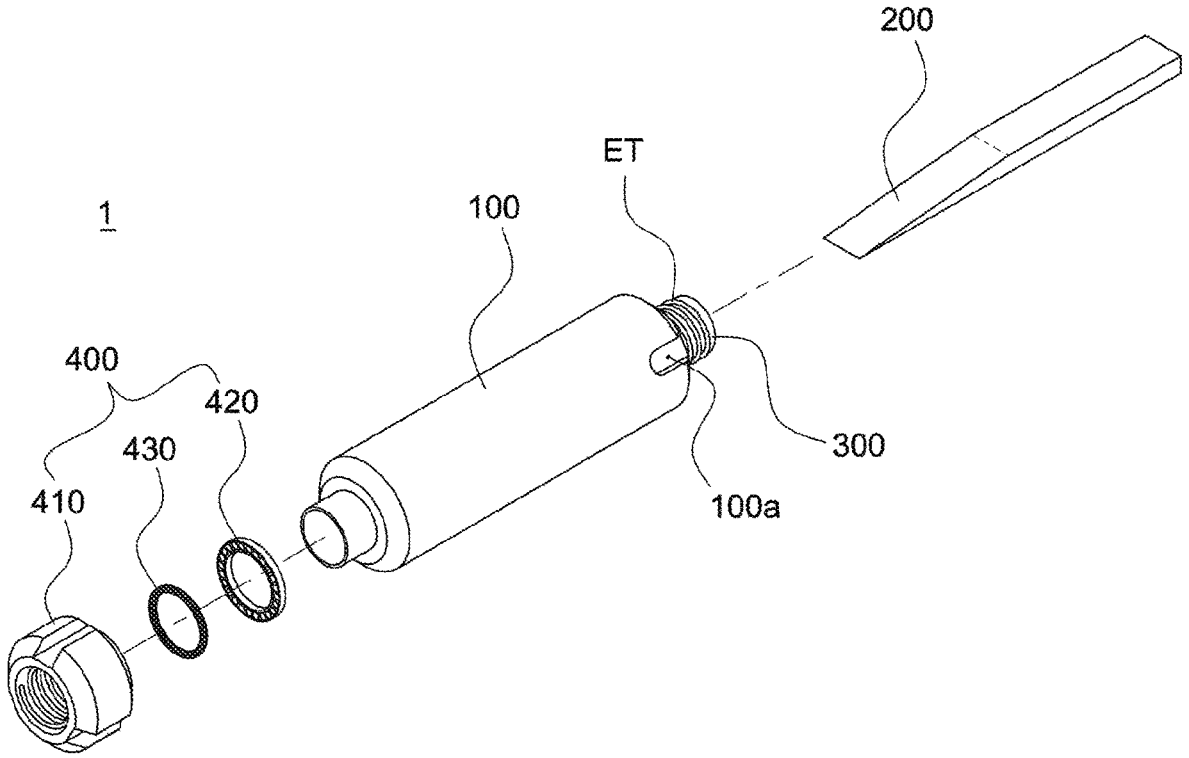
FIG. 3 is an exploded perspective view of the discharge pressure adjustment cartridge that is combined with fire hose pressure relief valve of the present invention.
Figure 4:
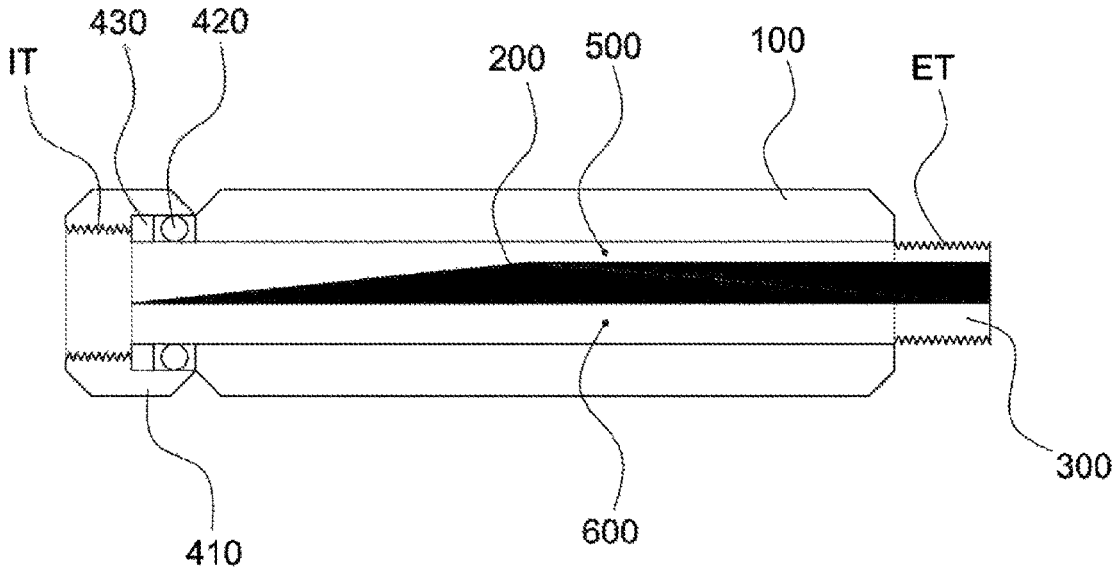
FIG. 4 is a cross-sectional view of the discharge pressure adjustment cartridge that is combined with fire hose pressure relief valve of the present invention.

FIG. 1 is a diagram showing the configuration of a discharge pressure adjustment cartridge that is combined with fire hose pressure relief valve of the present invention, FIG. 2 is a perspective view and a plan view of the discharge pressure adjustment cartridge that is combined with fire hose pressure relief valve of the present invention, FIG. 3 is an exploded perspective view of the discharge pressure adjustment cartridge that is combined with fire hose pressure relief valve of the present invention, and FIG. 4 is a cross-sectional view of the discharge pressure adjustment cartridge that is combined with fire hose pressure relief valve of the present invention.

As shown in FIGS. 1 to 4, a discharge pressure adjustment cartridge 1 that is combined with fire hose pressure relief valve of the present invention includes:

a hollow cartridge housing 100 having a predetermined length and having an end coupled to discharge equipment FN and the other end coupled to a fire hose pressure relief valve RV;

a discharge pressure adjustment nozzle 200 inserted and fixed in the cartridge housing 100 and adjusting the discharge pressure of firefighting water FW1 passing through the cartridge housing 100;

a discharge equipment-coupling portion 300 formed at an end of the cartridge housing 100 to be coupled to the discharge equipment FN;

a fire hose pressure relief valve-coupling portion 400 formed at the other end of the cartridge housing 100 to be coupled to the fire hose pressure relief valve RV;

a first firefighting water inflow section 500 formed over the discharge pressure adjustment nozzle 200 inserted and fixed in the cartridge housing 100; and a second firefighting water inflow section 600 formed under the discharge pressure adjustment nozzle 200 inserted and fixed in the cartridge housing 100.

The present invention is characterized by preventing the discharge equipment FN from unexpectedly moving up due to discharge pressure of the firefighting water FW1 flowing inside from the fire hose FH by adjusting the discharge pressure, and by enabling a firefighter to easily handle the discharge equipment FN by applying force in the gravity direction to the discharge equipment FN.

That is, the firefighting water FW1 flowing inside from the fire hose pressure relief valve RV is divided into the first firefighting water inflow section 500 and the second firefighting water inflow section 600 by the discharge pressure adjustment nozzle 200 when passing through the cartridge housing 100, so it becomes firefighting water FW2 with adjusted discharge pressure.

Figure 9:
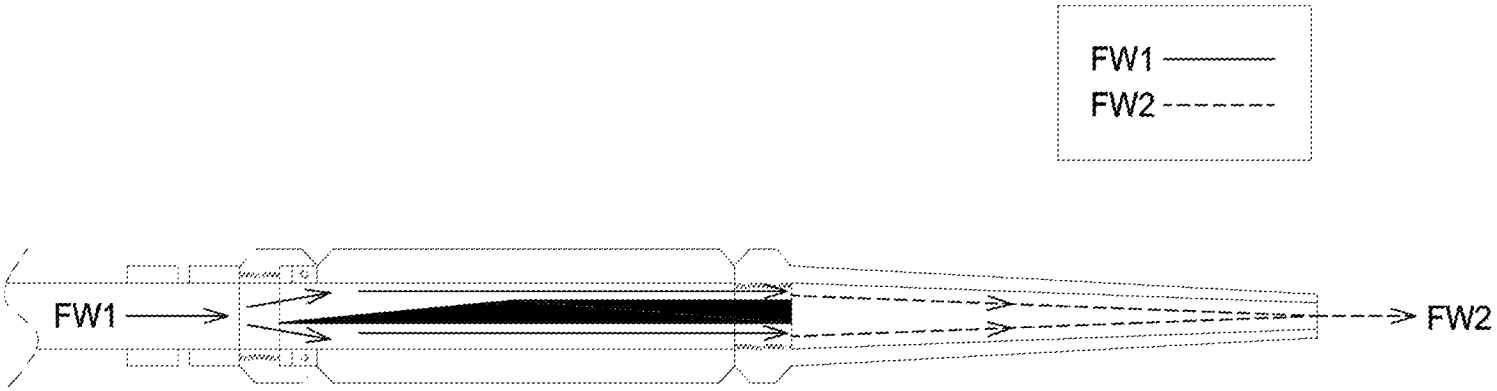
FIG. 9 is a schematic cross-sectional view showing the change of firefighting water discharged toward the discharge equipment from the discharge pressure adjustment cartridge that is combined with fire hose pressure relief valve of the present invention.
Figure 10:
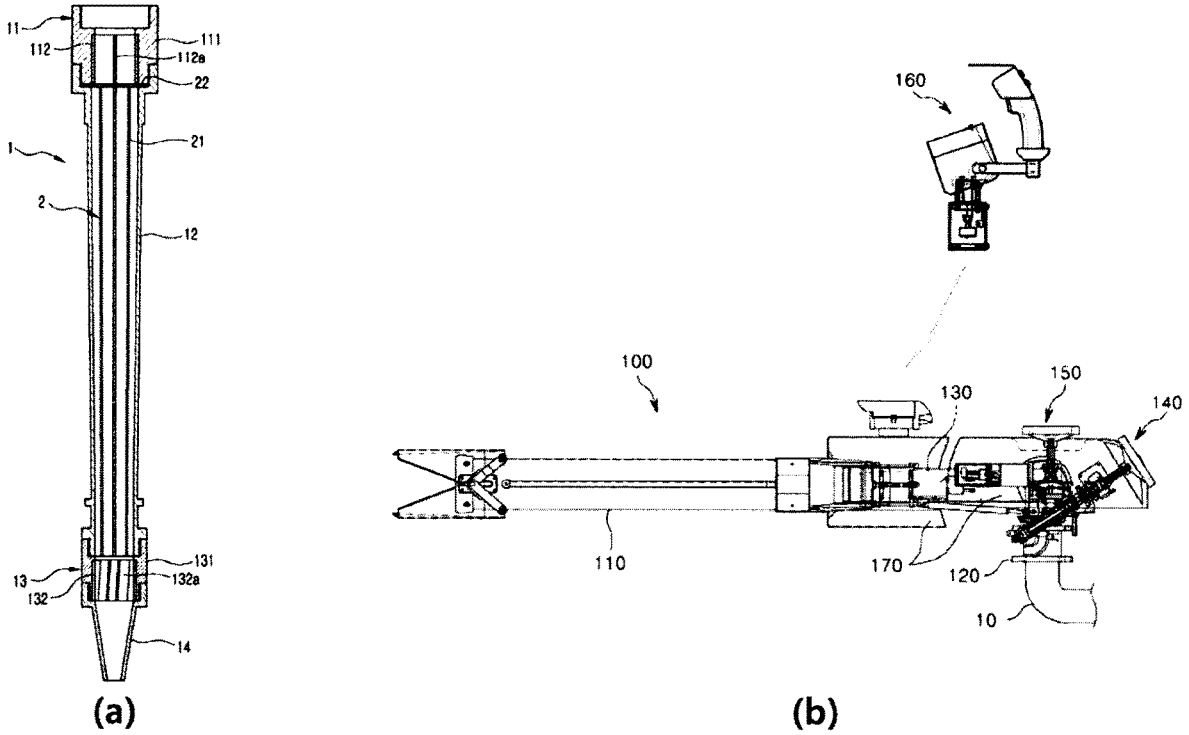
FIG. 10 BACKGROUND ART
FIG. 10 is a representative view of the prior art on the discharge pressure adjustment cartridge that is combined with fire hose pressure relief valve of the present invention.

This is described in more detail with reference to FIG. 9.

According to the discharge pressure adjustment cartridge 1 that is combined with fire hose pressure relief valve of the present invention, the firefighting water FW1 flowing inside from the fire hose pressure relief valve RV is divided into two streams by the discharge pressure adjustment nozzle 200 in the cartridge housing 100 such that one stream passes through the first firefighting water inflow section 500 and the other stream passes through the second firefighting water inflow section 600. The flowing speed of the firefighting water FW1 passing through the first firefighting water inflow section 500 is changed to be larger than the flowing speed of the firefighting water FW1 passing through the second firefighting water inflow section 600. Accordingly, upward force generated in the opposite direction to gravity of the firefighting water FW1 by discharge pressure is cancelled out, thereby adjusting the discharge pressure.

Figure 5:
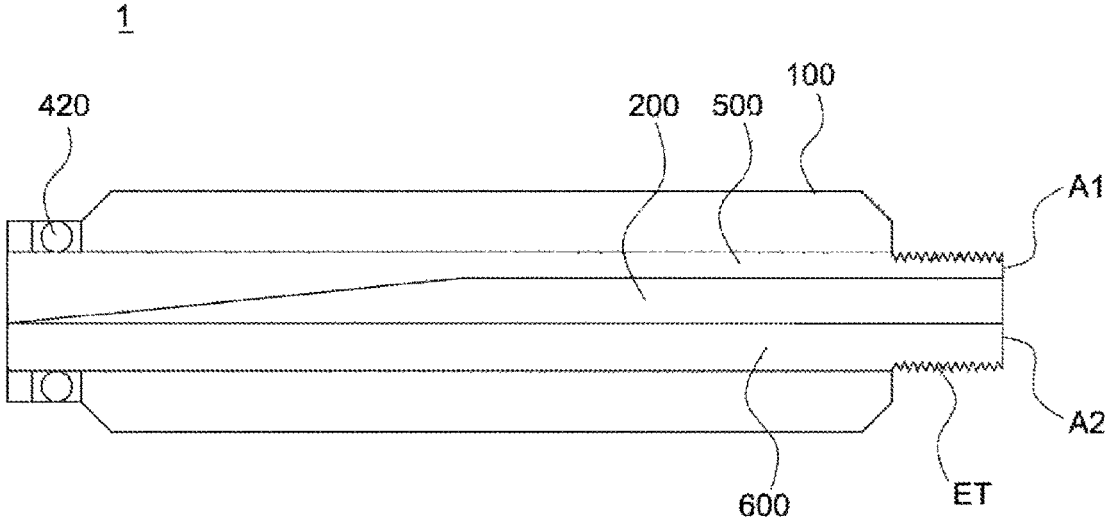
FIG. 5 is a schematic cross-sectional view of areas of a first firefighting water inflow section and a second firefighting water inflow section among the components of the discharge pressure adjustment cartridge that is combined with fire hose pressure relief valve of the present invention.

Accordingly, as shown in FIG. 5, the area A1 of the first firefighting water inflow section 500 should be smaller than the area A2 of the second firefighting water inflow section 600 (A1<A2).

The discharge pressure adjustment nozzle 200 that forms the first firefighting water inflow section 500 and the second firefighting water inflow section 600 by being inserted and fixed in the cartridge housing 100 and adjusts the discharge pressure of the firefighting water FW1 by dividing the firefighting water FW1, which flows inside from the fire hose pressure relief valve RV, into the first firefighting water inflow section 500 and the second firefighting water inflow section 600, in more detail, as shown in FIGS. 3 to 6, has:

a nozzle top 210 increasing the flowing speed of the firefighting water FW1 passing through the first firefighting water inflow section 500;

a nozzle bottom 220 enabling the firefighting water FW1 to pass through the second firefighting water inflow section 600;

a first nozzle surface 230 being in contact with ends of the nozzle top 210 and the nozzle bottom 220 and enabling the firefighting water FW1 flowing inside from the fire hose pressure relief valve RV to change into a firefighting water FW2 through the first firefighting water inflow section 500 and the second firefighting water inflow section 600 and to be discharged to a fire position through the discharge equipment FN;

a second nozzle surface 240 being in contact with the nozzle top 210 and the nozzle bottom 220, extending downward with a predetermined inclination from the nozzle top 210, and dividing the firefighting water FW1 flowing inside from the fire hose pressure relief valve RV; and a firefighting water division blade 250 pointed at the joint of the second nozzle surface 240 and the nozzle bottom 220 to enable firefighting water FW1 flowing inside from the fire hose pressure relief valve RV to be divided without resistance.

Figure 6:
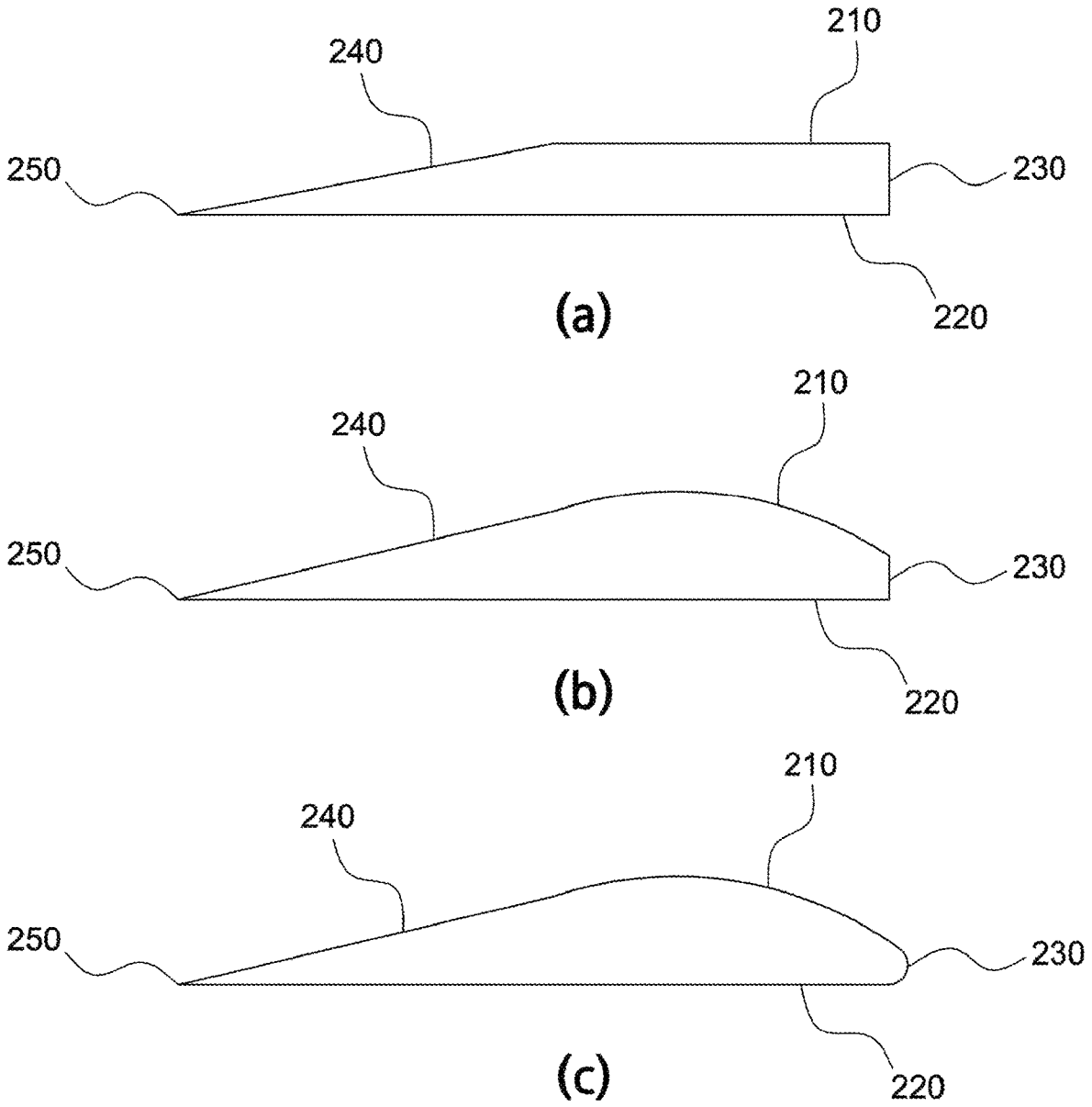
FIG. 6 is a front view of an embodiment of a discharge pressure adjustment nozzle among the components of the discharge pressure adjustment cartridge that is combined with fire hose pressure relief valve of the present invention.

As described above, the discharge pressure adjustment nozzle 200 that may be formed in various shapes, as shown in FIG. 6, is inserted in the cartridge housing 100 to form the first firefighting water inflow section 500 and the second firefighting water inflow section 600 in the cartridge housing 100. Further, the discharge pressure adjustment nozzle 200 should be configured such that the firefighting water FW1 passing through the first firefighting water inflow section 500 is larger in flowing speed than the firefighting water FW1 passing through the second firefighting water inflow section 600.

That is, as described above, the firefighting water FW1 flowing over the nozzle top 210 should be larger in flowing speed than the firefighting water FW1 flowing under the nozzle bottom 220.

The firefighting water division blade 250 is configured to prevent non-uniform flow and vortex due to sudden friction with the discharge pressure adjustment nozzle 200 when the firefighting water FW1 flowing inside from the fire hose pressure relief valve RV is divided by the discharge pressure adjustment nozzle 200.

On the other hand, the fire hose pressure relief valve-coupling portion 400 for coupling the other end of the cartridge housing 100 to the fire hose pressure relief valve RV, as shown in FIGS. 3 and 4, as an embodiment, includes:

a pressure relief valve-coupling rotary plate 410 having a female thread at a side on the inner surface to insert and couple a male thread ET formed on the fire hose pressure relief valve RV;

a rotary plate bearing 420 inserted and fixed in a side of the pressure relief valve-coupling rotary plate 410 to couple the fire hose pressure relief valve RV to the cartridge housing 100 by rotating the pressure relief valve-coupling rotary plate 410 such that the pressure relief valve-coupling rotary plate 410 idles with respect to the cartridge housing 100; and a watertight packing 430 disposed at the portion where the fire hose pressure relief valve RV and the other end of the cartridge housing 100 are in close contact to keep the fire hose pressure relief valve RV and the other end of the cartridge housing 100 more close contact and watertight.

The pressure relief valve-coupling rotary plate 410 further has a pressure relief valve-coupling grooves 410*a* formed in a predetermined pattern around the outer side so that a firefighter can easily couple the fire hose pressure relief valve RV to the other end of the cartridge housing 100 immediately at a fire scene even without a specific tool. Accordingly, the fire hose pressure relief valve RV can be easily coupled to the cartridge housing 100.

Further, the cartridge housing 100 further has discharge pressure adjustment cartridge grooves 100*a* formed at a side around the outer side so that a firefighter can easily hold the cartridge housing and the end of the cartridge housing 100 can be easily coupled to the discharge equipment FN. Accordingly, a firefighter can safely hold the discharge pressure adjustment cartridge 1 that is combined with fire hose pressure relief valve of the present invention for long time and can safely couple the discharge equipment FN even without a specific tool.

The discharge equipment FN and the discharge pressure adjustment cartridge 1 that is combined with fire hose pressure relief valve of the present invention may be separably combined or may be integrally formed not to separate once combined.

When the discharge equipment FN and the discharge pressure adjustment cartridge 1 that is combined with fire hose pressure relief valve of the present invention are separably combined, discharge equipment-coupling grooves FNa are formed at a side around the outer side of the discharge equipment FN for easy coupling and separating, so a firefighter can easily separate and couple the discharge equipment FN from and to the cartridge housing 100 even without a specific tool.

Further, the discharge equipment-coupling portion 300 formed at an end of the cartridge housing 100 to be coupled to the discharge equipment FN, as an embodiment, as shown in FIGS. 3 and 4, may be a male-threaded portion ET extending and protruding a predetermined length from the end of the cartridge housing 100 to be inserted and thread-fastened to a female thread IT formed at a side in an end of the discharge equipment FN.

Figure 7:
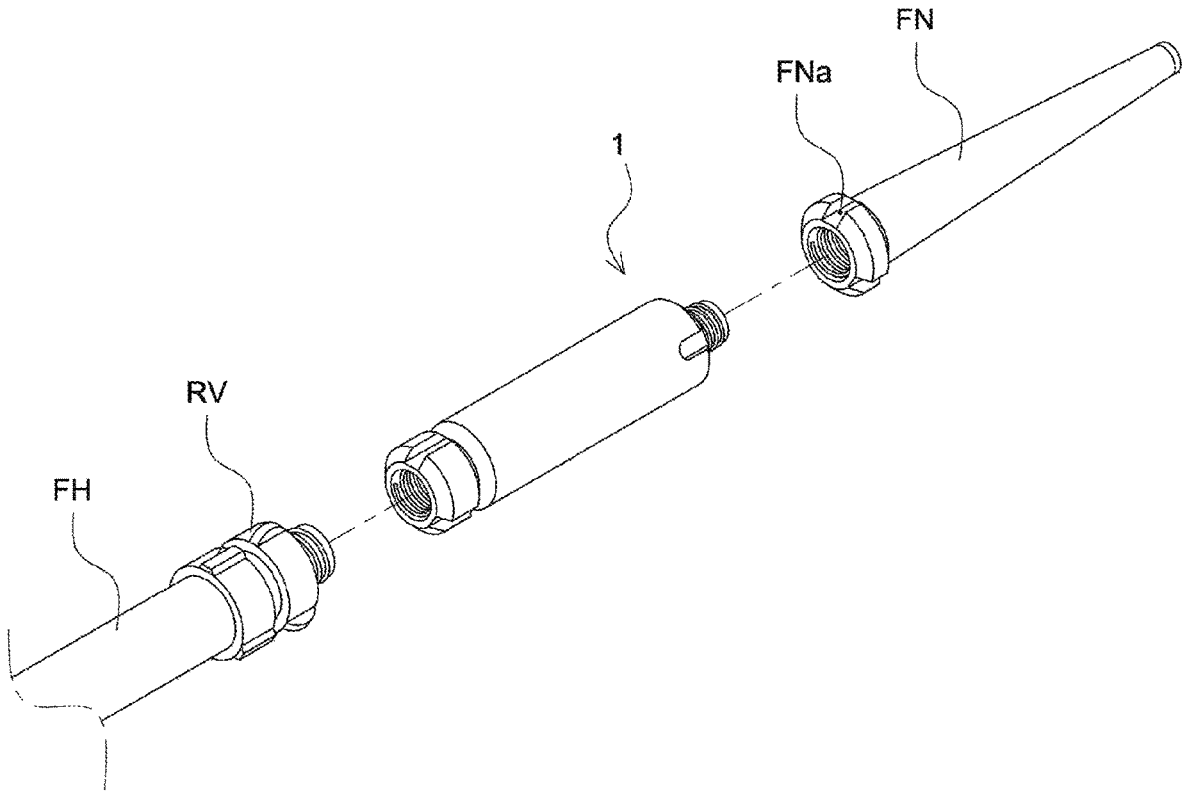
FIG. 7 is an exploded perspective view of an applying embodiment of the discharge pressure adjustment cartridge that is combined with fire hose pressure relief valve of the present invention.

As described above, according to the present invention as shown in FIG. 7, the discharge equipment FN, the discharge pressure adjustment cartridge 1 that is combined with fire hose pressure relief valve, and the fire hose pressure relief valve RV are combined to be used by a firefighter at a fire scene.

Figure 8:
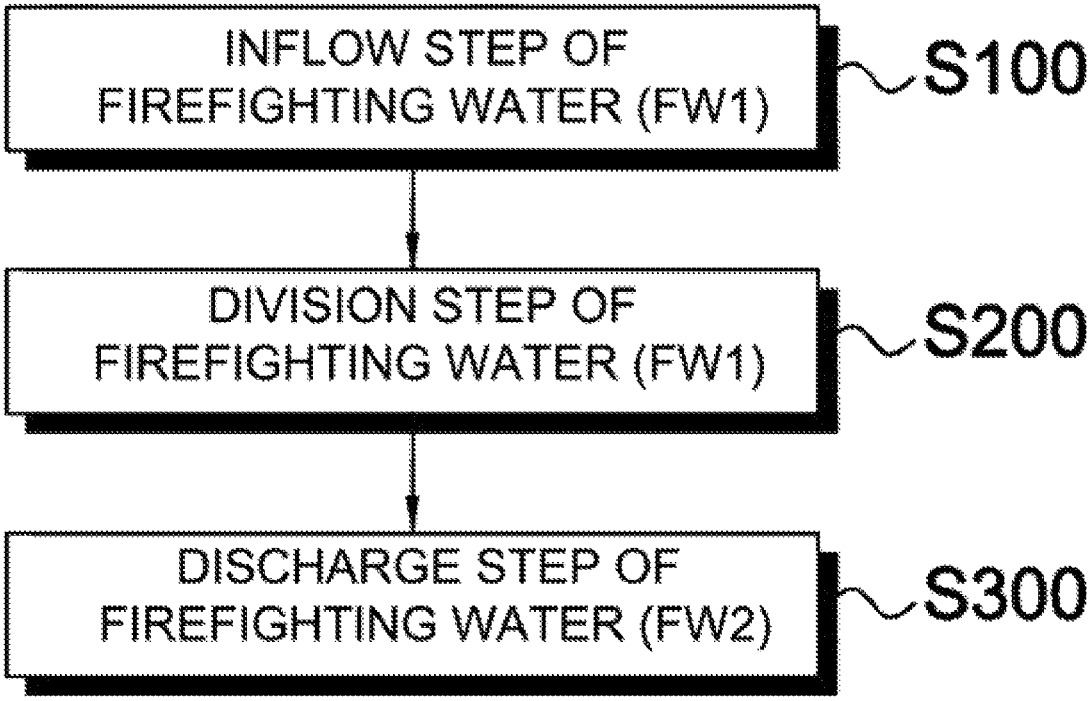
FIG. 8 is a schematic flow chart of the firefighting water discharged from the discharge pressure adjustment cartridge that is combined with fire hose pressure relief valve of the present invention.

The flow of the firefighting water FW2 that is discharged to a fire position by the present invention is briefly described with reference to FIGS. 8 and 9.

First, the firefighting water FW1 flows into the cartridge housing 100 from the fire hose pressure relief valve RV ( ▶ inflow step of firefighting water FW1 (S100).

The firefighting water FW1 flowing in the cartridge housing 100 is divided into two streams by the discharge pressure adjustment nozzle 200 (▶ division step of firefighting water FW1 (S200).

The firefighting water FW1 is changed into firefighting water FW2 with adjusted discharge pressure and is discharged through the discharge equipment FN (▶ discharge step of firefighting water FW2 (S300).

In conclusion, the discharge pressure adjustment cartridge 1 that is combined with fire hose pressure relief valve of the present invention is a technology enabling even one firefighter to easily handle the discharge equipment FN, that is, a discharge gun by canceling out upward force, which is generated by discharge pressure and applied in the opposite direction to gravity, of the firefighting water FW1 that is discharged at a fire scene by increasing the flowing speed, and is configured to correspond to fire hose pressure relief valves RV that have been standardized and produced.

Further, an end of the discharge pressure adjustment cartridge 1 that is combined with fire hose pressure relief valve of the present invention is coupled to the discharge equipment FN and the other end is coupled to the fire hose pressure relief valve RV.

The discharge equipment FN is a kind of nozzle that improves straightness of the firefighting water FW2 such that the firefighting water FW2 that has passed through the discharge pressure adjustment cartridge 1 that is combined with fire hose pressure relief valve of the present invention is discharged to a fire position, and various nozzles may be used, depending on the situations of fire scenes.

For example, as an embodiment shown in FIG. 7, the discharge equipment FN is formed in a conical shape to improve straightness of the firefighting water FW2. However, the discharge equipment FN should be formed in a cylindrical shape rather than the conical shape in order to improve the discharge amount of the firefighting water FW2 rather than the straightness of the firefighting water FW2.

For reference, in the terms used to describe the present invention, the 'discharge gun' means the combination of the discharge equipment FN and the discharge pressure adjustment cartridge 1 that is combined with fire hose pressure relief valve of the present invention, as shown in FIG. 7.

The 'discharge pressure' means the pressure at which firefighting water FW1 is discharged.

The 'adjustment of discharge pressure' is to remove the upward force of the firefighting water FW1 such that the firefighting water FW2 is discharged straight in parallel with the ground by canceling out the force generated by discharge pressure and applied (upward) in the opposed direction to gravity in the firefighting water FW1 flowing inside from the fire hose pressure relief valve RV using the discharge pressure adjustment cartridge 1 that is combined with fire hose pressure relief valve of the present invention.

The 'straightness of firefighting water FW2' means that the range of the firefighting water FW2 is large.

It will be apparent to those skilled in the art that various modifications and variations can be made in the present invention without departing from the spirit or scope of the invention as defined in the appended claims.

This invention can be implemented in many different forms without departing from technical aspects or main features. Therefore, the implementation examples of this invention are nothing more than simple examples in all respects and will not be interpreted restrictively.

INDUSTRIAL APPLICABILITY

The present invention relates to a discharge pressure adjustment cartridge that is combined with a fire hose pressure relief valve, and is a firefighting instrument used in construction and sales business for manufacturing the same, rescue and rescue activities for extinguishing a fire, thereby contributing to the promotion of various activities and industrial fields related to the firefighting.

What is claimed is:

1. A discharge pressure adjustment cartridge that is combined with a fire hose pressure relief valve, the discharge pressure adjustment cartridge comprising:

a hollow cartridge housing having a predetermined length and having an end coupled to discharge equipment and the other end coupled to the fire hose pressure relief valve;

a discharge pressure adjustment nozzle inserted and fixed in the cartridge housing and adjusting the discharge pressure of firefighting water passing through the cartridge housing;

a discharge equipment-coupling portion formed at an end of the cartridge housing to be coupled to the discharge equipment;

a fire hose pressure relief valve-coupling portion formed at the other end of the cartridge housing to be coupled to the fire hose pressure relief valve;

a first firefighting water inflow section formed over the discharge pressure adjustment nozzle inserted and fixed in the cartridge housing; and a second firefighting water inflow section formed under the discharge pressure adjustment nozzle inserted and fixed in the cartridge housing, wherein a cross-sectional area through the first firefighting water inflow section is smaller than a cross-sectional area through the second firefighting water inflow section, the discharge pressure adjustment nozzle includes:

a nozzle top increasing the flowing speed of the firefighting water passing through the first firefighting water inflow section;

a nozzle bottom enabling the firefighting water to pass through the second firefighting water inflow section;

a first nozzle surface being in contact with ends of the nozzle top and the nozzle bottom and enabling the firefighting water flowing inside from the fire hose pressure relief valve to change into a firefighting water through the first firefighting water inflow section and the second firefighting water inflow section and to be discharged to a fire position through the discharge equipment;

a second nozzle surface being in contact with the nozzle top and the nozzle bottom, extending downward with a predetermined inclination from the nozzle top, and dividing the firefighting water (FW1) flowing inside from the fire hose pressure relief valve; and a firefighting water division blade pointed at the joint of the second nozzle surface and the nozzle bottom to enable firefighting water flowing inside from the fire hose pressure relief valve to be divided without resistance, wherein the firefighting water flowing inside through the fire hose pressure relief valve from the fire hose is divided into two streams to pass through the first firefighting water inflow section and the second firefighting water inflow section, and wherein the nozzle bottom is flat from one longitudinal end to an opposite longitudinal end.

2. The discharge pressure adjustment cartridge of claim 1, wherein the second nozzle surface is inclined such that the nozzle top is smaller than the nozzle bottom in surface area.

3. The discharge pressure adjustment cartridge of claim 1, wherein the nozzle top, the first nozzle surface and the second nozzle surface are straight surfaces.

4. The discharge pressure adjustment cartridge of claim 1, wherein the first nozzle surface and the second nozzle surface are flat surfaces, and the nozzle top is a curved surface.

5. The discharge pressure adjustment cartridge of claim 1, wherein the second nozzle surface is a flat surface, and the nozzle top and the first nozzle surface are curved surfaces.

* * * * *